US008913046B2

(12) United States Patent
Lee et al.

(10) Patent No.: US 8,913,046 B2
(45) Date of Patent: Dec. 16, 2014

(54) LIQUID CRYSTAL DISPLAY AND DRIVING METHOD THEREOF

(75) Inventors: Seung-Kyu Lee, Yongin (KR); Kyung-Hoon Kim, Yongin (KR); Yang-Hwa Choi, Yongin (KR); Se-Hyang Kim, Yongin (KR); Chul-Ho Kim, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 209 days.

(21) Appl. No.: 13/051,082

(22) Filed: Mar. 18, 2011

(65) Prior Publication Data

US 2012/0098816 A1 Apr. 26, 2012

(30) Foreign Application Priority Data

Oct. 22, 2010 (KR) ..... 10-2010-0103507

(51) Int. Cl.
*G09G 5/00* (2006.01)
*G09G 3/36* (2006.01)

(52) U.S. Cl.
CPC ..... *G09G 3/3648* (2013.01); *G09G 2320/0214* (2013.01); *G09G 2330/021* (2013.01); *G09G 3/3655* (2013.01); *G09G 2300/0814* (2013.01)
USPC ..... 345/204; 345/87

(58) Field of Classification Search
USPC ..... 345/87, 204
See application file for complete search history.

(56) References Cited

U.S. PATENT DOCUMENTS

| | | | | |
|---|---|---|---|---|
| 6,040,814 | A * | 3/2000 | Murakami et al. | 345/94 |
| 2008/0284768 | A1* | 11/2008 | Yoshida et al. | 345/208 |
| 2009/0278776 | A1* | 11/2009 | Pai et al. | 345/87 |
| 2011/0234564 | A1 | 9/2011 | Kim et al. | 345/211 |

FOREIGN PATENT DOCUMENTS

| | | |
|---|---|---|
| KR | 10-2008-0112095 | 12/2008 |
| KR | 10-2009-0032712 | 4/2009 |
| KR | 10-0926687 | 11/2009 |

* cited by examiner

*Primary Examiner* — Alexander Eisen
*Assistant Examiner* — Mark Regn
(74) *Attorney, Agent, or Firm* — Robert E. Bushnell, Esq.

(57) ABSTRACT

An LCD and a driving method thereof include: data writing for applying a common voltage and a data voltage to a plurality of pixels; and sustaining for applying a shifted common voltage shifted by a predetermined level from the common voltage to the plurality of pixels for a sustain period during which the plurality of pixels emit light, corresponding to the data voltage. The shifted common voltage is shifted to an opposite polarity of a polarity of a gate-off voltage applied to the plurality of pixels to float the plurality of pixels. During a sustain period, a gate-source voltage of the switching transistor can be increased, and accordingly an influence due to the leakage current can be minimized, thereby preventing image deterioration. Further, since capacitance of the sustain capacitor can be reduced so that power consumption of the LCD can be reduced.

18 Claims, 6 Drawing Sheets

LIQUID CRYSTAL DISPLAY AND DRIVING METHOD THEREOF

CLAIM OF PRIORITY

This application makes reference to, incorporates the same herein, and claims all benefits accruing under 35 U.S.C. §119 from an application earlier filed in the Korean Intellectual Property Office on Oct. 22, 2010 and there duly assigned Serial No. 10-2010-0103507.

BACKGROUND OF THE INVENTION

1. Field of the Invention

The present invention relates to a liquid crystal display (LCD), and a driving method thereof. More particularly, the present invention relates to an LCD that can minimize a leakage current and reduce power consumption, and a driving method thereof.

2. Description of the Related Art

As a representative display device, a liquid crystal display (LCD) includes two display panels provided with pixel electrodes and a common electrode and a liquid crystal layer having dielectric anisotropy and interposed between the two panels. The pixel electrodes are arranged in a matrix format and are connected to a switch such as a thin film transistor (TFT) to sequentially receive a data voltage by row. The common electrode is formed over the entire surface of the display panel to receive a common voltage. The pixel electrodes, the common electrode, and the liquid crystal layer interposed between the pixel electrodes and the common electrode form a liquid crystal capacitor from a circuital view, and the liquid crystal capacitor and a switch connected thereto become a basic unit forming a pixel.

In the liquid crystal display (LCD), an electric field is generated in the liquid crystal layer by applying voltages to the two electrodes, and transmittance of light passing through the liquid crystal layer is controlled by controlling the electric field to thereby display a desired image. The LCD inverts the voltage polarity of a data signal for a common voltage for each frame, row, or pixel in order to prevent a degradation phenomenon that occurs when an electric field is applied in one direction to the liquid crystal layer for a long time.

For reducing power consumption of the LCD, data is written in the plurality of pixels during a short data writing period and light emission of the plurality of pixels is maintained during a long sustain period. During the sustain period, a voltage of each pixel should be maintained in a constant level. A leakage current may be generated in a pixel due to a characteristic of a TFT used in the pixel, and the voltage of each pixel may not be constantly maintained due to the leakage current. The leakage current causes image deterioration such as luminance change, line patterns, or cross-talk.

When capacitance of a capacitor that maintains the voltage of each pixel is increased, the influence of the leakage current can be decreased and the voltage of each pixel can be maintained in a constant level for a long period of time. However, when the capacitance is increased, power consumption may be increased and a circuit structure may be complicated.

Thus, a method for reducing the leakage current without increasing the capacitance of the capacitor is required.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a liquid crystal display (LCD) that can minimize the influence of a leakage current without reducing capacitance of a capacitor and reduce power consumption, and a driving method thereof.

A driving method of an LCD according to an exemplary embodiment of the present invention include: data writing for applying a common voltage and a data voltage to a plurality of pixels; and sustaining for applying a shifted common voltage shifted by a predetermined level from the common voltage to the plurality of pixels for a sustain period during which the plurality of pixels emit light, corresponding to the data voltage. The shifted common voltage is shifted to an opposite polarity of a polarity of a gate-off voltage applied to the plurality of pixels to float the plurality of pixels.

The data writing may include turning on a switching transistor connected with each of the plurality of pixels by sequentially applying a gate-on voltage to a plurality of scan lines respectively connected to the plurality of pixels; and applying a data voltage corresponding to each of the plurality of pixels through the turned-on switching transistor.

The sustaining may include turning off the switching transistor connected to the respective scan lines by applying the gate-off voltage to the scan lines.

A voltage difference between a gate terminal and a source terminal of the turned-off switching transistor may be increased by applying the shifted common voltage.

The switching transistor may be an n-channel field effect transistor. The gate-on voltage may be a logic high level voltage and the gate-off voltage is a logic low level voltage. The shifted common voltage may be a voltage increased by a predetermined level from the common voltage.

The switching transistor may be a p-channel field effect transistor. The gate-on voltage may be a logic low level voltage and the gate-off voltage may be a logic high level voltage. The shifted common voltage may be decreased by a predetermined level from the common voltage.

An LCD according to another exemplary embodiment of the present invention includes: a liquid crystal panel including a plurality of pixels; a liquid crystal panel including the plurality of pixels; a data driver applying a data voltage corresponding to each of the plurality of pixels through the turned-on switching transistor; and a power supply applying a common voltage for a data writing period during which the data voltage is applied to the plurality of pixels. The scan driver applies a gate-off voltage that turns off the switching transistor after the data voltage is applied to the plurality of pixels, and the power supply applies a shifted common voltage shifted to an opposite polarity of a polarity of the gate-off voltage.

The switching transistor may be an n-channel field effect transistor. The gate-on voltage may be a logic high level voltage and the gate-off voltage may be a logic low level voltage. The shifted common voltage may be a voltage increased by a predetermined level from the common voltage.

The switching transistor may be a p-channel field effect transistor. The gate-on voltage may be a logic low level voltage and the gate-off voltage may be a logic high level voltage. The shifted common voltage may be a voltage decreased by a predetermined level from the common voltage.

During a sustain period, a gate-source voltage of the switching transistor can be increased, and accordingly an influence due to the leakage current can be minimized, thereby preventing image deterioration. Further, since capacitance of the sustain capacitor can be reduced so that power consumption of the LCD can be reduced.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
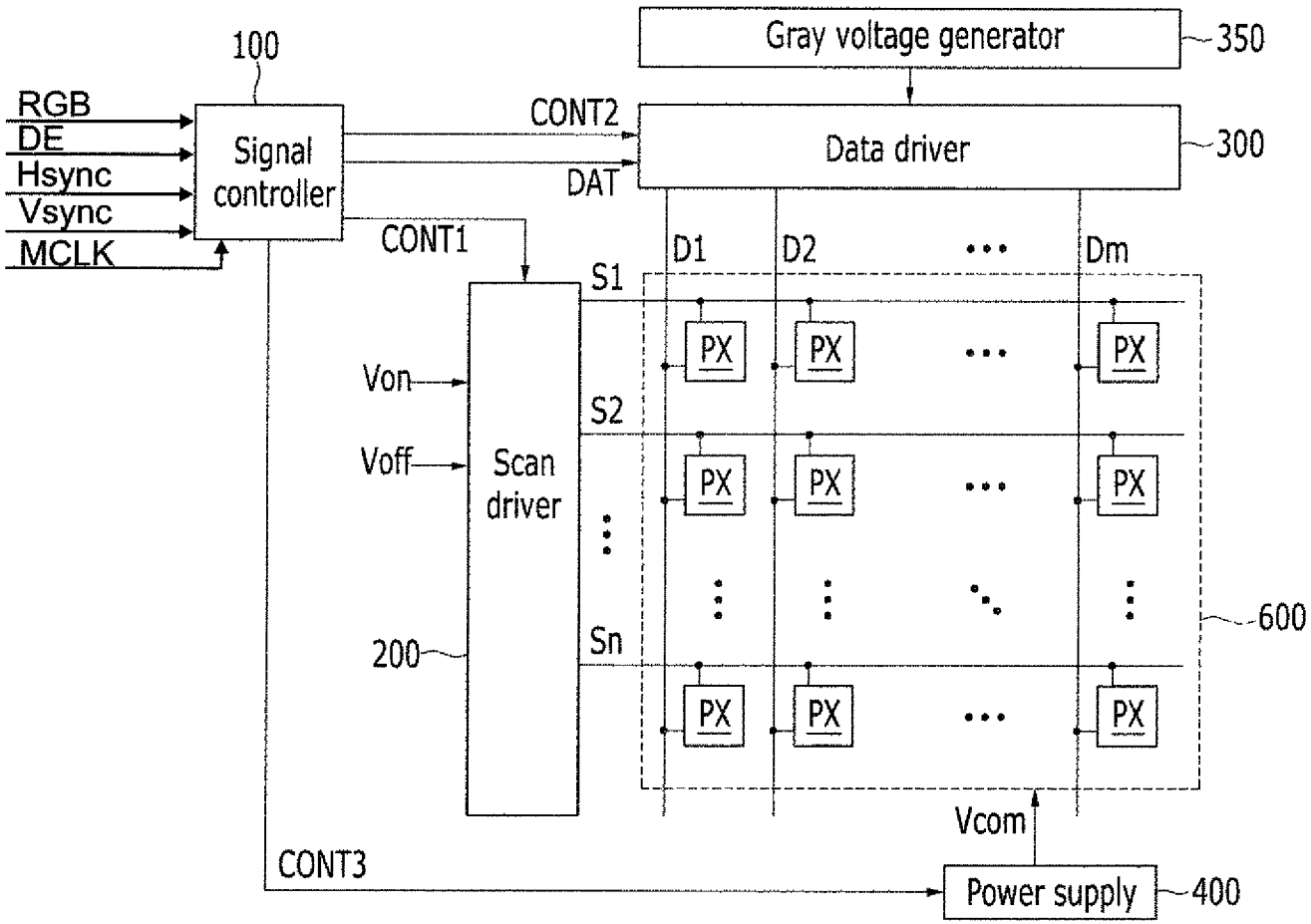
FIG. 1 is a block diagram of a liquid crystal display (LCD) according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

Further, in the exemplary embodiments, like reference numerals designate like elements throughout the specification representatively in a first exemplary embodiment, and only elements other than those of the first exemplary embodiment will be described.

The drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a liquid crystal display (LCD) according to an exemplary embodiment of the present invention.

Referring to FIG. 1, the LCD includes a liquid crystal panel assembly 600, a scan driver 200 connected to the liquid crystal panel assembly 600, a data driver 300, a gray voltage generator 350 connected to the data driver 300, a power supply 400, and a signal controller 100 controlling the respective drivers.

The liquid crystal panel assembly 600 includes a plurality of scan lines S1 to Sn, a plurality of data lines D1 to Dm, and a plurality of pixels PX. The pixels PX are connected to the plurality of signal lines S1 to Sn and D1 to Dm and arranged in a matrix format. The plurality of scan lines S1 to Sn are extended approximately in a row direction and they are almost parallel with each other. The plurality of data lines D1 to Dm are extended approximately in a column direction and they are almost parallel with each other. At least one polarizer (not shown) that polarizes light is attached to an outer side of the liquid crystal panel assembly 600.

The signal controller 100 receives image signals R, G, and B and an input control signal for controlling the image signals from an external device. The input control signal includes a data enable signal DE, a horizontal synchronization signal Hsync, a vertical synchronization signal Vsync, and a main clock signal MCLK. The signal controller 100 provides an image data signal DAT and a data control signal CONT2 to the data driver 300.

As a signal that controls operation of the data driver 300, the data control signal CONT2 includes a horizontal synchronization start signal that informs the transmission start of the image data signal DAT, a load signal instructing output of the data voltage to the data lines D1 to Dm, and a data clock signal. The data control signal CONT2 may further include a reverse signal that reverses a voltage polarity of an image data signal with respect to a common voltage Vcom.

The signal controller 100 provides a scan control signal CONT1 to the scan driver 200. The scan control signal CONT1 includes at least one clock signal that controls output of a scan start signal and a gate-on voltage from the scan driver 200. The scan control signal CONT1 may further include an output enable signal that limits a duration time of the gate-on voltage.

The signal controller 100 provides a power control signal CONT3 to the power supply 400. The power control signal CONT3 controls output of the common voltage Vcom applied to each pixel PX from the power supply 400.

Figure 2:
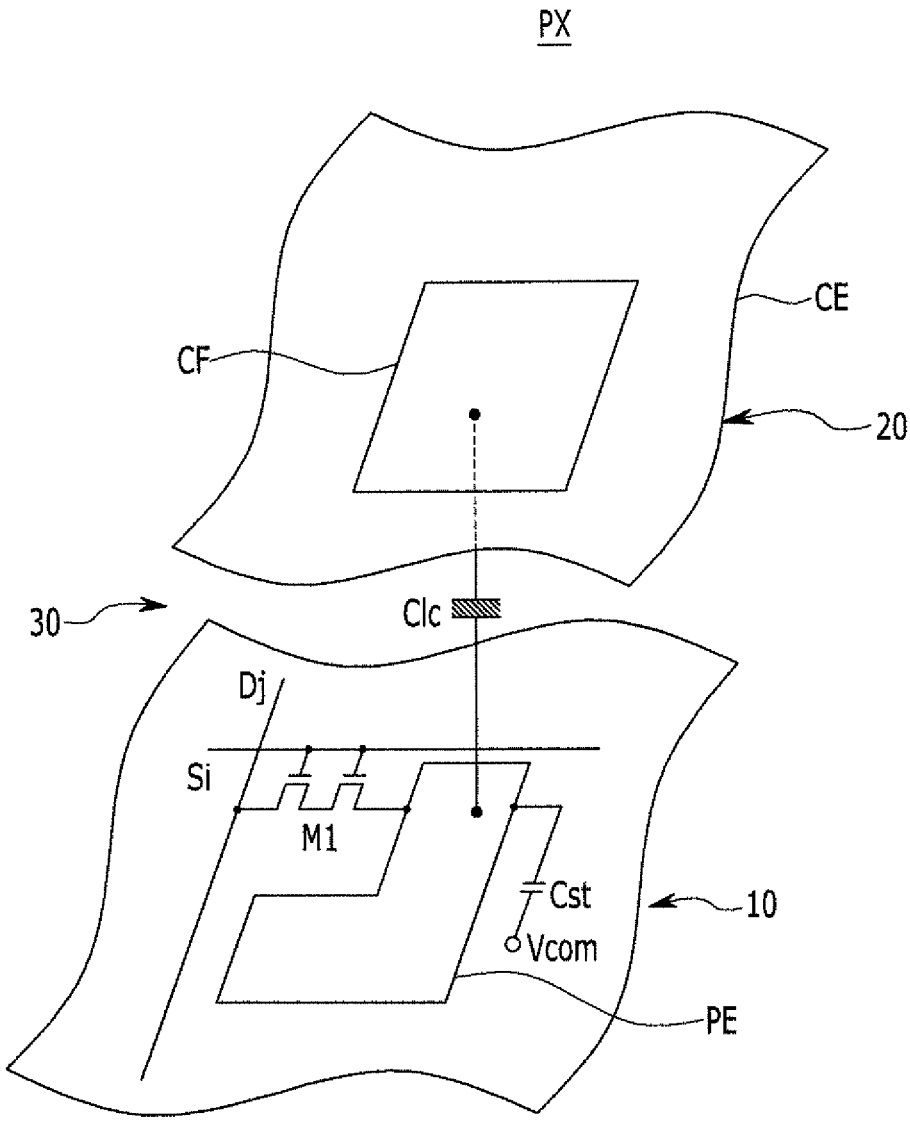
FIG. 2 is an equivalent circuit diagram of one pixel of FIG. 1.

The scan driver 200 is connected to the plurality of scan lines S1 to Sn of the liquid crystal panel assembly 600 and applies a scan signal formed of a combination of the gate-on voltage that turns on the switching transistor M1 of FIG. 2 and a gate-off voltage that turns off the switching transistor M1 to the plurality of scan lines S1 to Sn.

The data driver 300 is connected to the data lines D1 to Dm of the liquid crystal panel assembly 600, and selects a gray voltage supplied by the gray voltage generator 350. The data driver 300 applies the selected gray voltage to the plurality of data lines D1 to Dm as a data signal. The gray voltage generator 350 can only provide a predetermined number of reference gray voltages rather than providing voltages for all grays, and in this case, the data driver 300 generates a gray voltage for all grays by dividing a reference gray voltage and a data voltage corresponding to a data signal can be selected therefrom.

The power supply 400 applies the common voltage Vcom to a common electrode CE of FIG. 2 of each pixel PX. The power supply 400 shifts a level of the common voltage Vcom according to the power control signal CONT3 and applies the level-shifted voltage.

Figure 4:
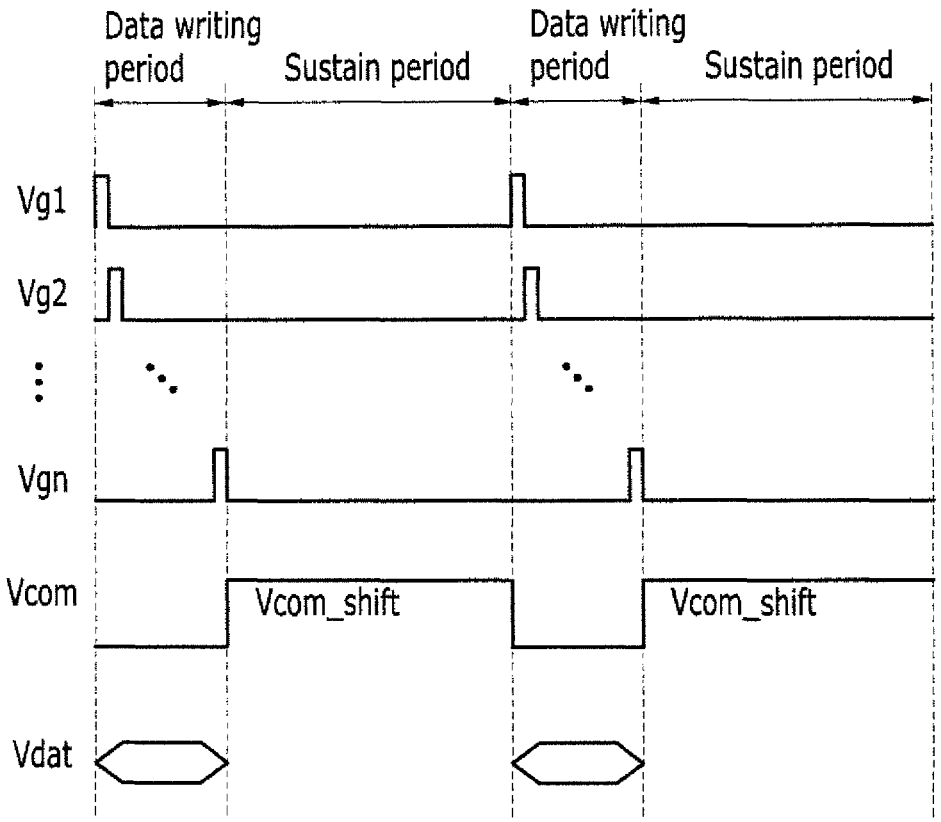
FIG. 4 is a timing diagram for description of operation of the LCD of FIG. 1.

In further detail, as shown in FIG. 4, the power supply 400 applies a common voltage Vcom of about 0V to each pixel PX for a data writing period during, and applies a shifted common voltage Vcom_shift of a predetermined level for a sustain period during which a pixel voltage of each pixel PX is constantly maintained. The shifted common voltage Vcom_shift is shifted to a polarity that is opposite to a polarity of a gate-off voltage applied to the plurality of pixels PX to float the plurality of pixels PX. When the shifted common voltage Vcom_shift is applied, a voltage difference between a gate terminal and a source terminal of a turned off switching transistor is increased. The voltage difference between a gate terminal and a source terminal is referred to a gate-source voltage.

The respective driving apparatuses 100, 200, 300, 350, and 400 may be directly mounted in the shape of at least one integrated circuit (IC) chip on the liquid crystal panel assembly 600, may be mounted on a flexible printed circuit film, may be attached in the shape of a tape carrier package (TCP) to the liquid crystal panel assembly 600, or may be mounted on an additional printed circuit board. Alternatively, the driving apparatuses 100, 200, 300, 350, and 400 may be integrated to the panel assembly 600 together with signal lines S1 to Sn and D1 to Dm.

FIG. 2 shows an equivalent circuit of one pixel of FIG. 1.

Referring to FIG. 2, the liquid crystal panel assembly includes a thin film transistor panel 10, a common electrode panel 20, a liquid crystal layer 30, and a spacer (not shown) pressure-deformed while forming a space between the two panels 10 and 20. Here, the thin film transistor panel 10 and the common electrode panel 20 face each other.

A pixel PX of the liquid crystal panel assembly is included to the i-th scan line Si (i=1 to n) and the j-th data line Dj (j=1 to m), and includes a switching transistor M1, a liquid crystal capacitor Clc, and a sustain capacitor Cst. The liquid crystal capacitor Clc and the sustain capacitor Cst are connected to the switching transistor M1.

The switching transistor M1 is a three-terminal element such as a thin film transistor, provided in the thin film transistor panel 10, and includes a gate terminal connected to the scan line Si and an output terminal connected to a pixel electrode PE of the liquid crystal capacitor Clc. The thin film transistor includes amorphous silicon or poly crystalline silicon.

The liquid crystal capacitor Clc includes a pixel electrode PE of the thin film transistor panel 10 and a common electrode CE of the common electrode panel 20, arranged facing the pixel electrode PE. That is, the liquid crystal capacitor Clc uses the pixel electrode PE of the thin film transistor panel 10 and the common electrode CE of the common electrode panel 20 as two terminals, and the liquid crystal layer 30 between the pixel electrode PE and the common electrode CE functions as a dielectric material.

The pixel electrode PE is connected to the switching transistor M1, and the common electrode CE is formed at a front side of the common electrode panel 20 and receives the common voltage Vcom and the shifted common voltage Vcom_shift. Meanwhile, the common electrode CE may be provided in the thin film transistor panel 10, and, in this case, at least one of the pixel electrode PE and the common electrode CE may be formed in the shape of a line or a bar. The common voltage Vcom may have a voltage of about 0V. The shifted common voltage Vcom_shift may have a predetermined level of voltage that increases a gate-source voltage of the turned-off switching transistor M1.

The sustain capacitor Cst includes a first end connected to the pixel electrode PE and a second end connected to a wire that transfers the common voltage Vcom. The wire may be formed to connected the common electrode CE with a second end of the sustain capacitor, but it may be formed as a separate electrode to transfer the common voltage Vcom to the second end of the sustain capacitor Cst.

A color filer CF may be formed in a part of the common electrode CE of the common electrode panel 20. In order to represent colors, each pixel PX displays one of primary colors (i.e., spatial division) or each pixel PX displays primary colors according to time (i.e., time division) so that a desired color can be expressed by the spatial and temporal sum of the primary colors. The primary colors may be three primary colors of red, green, and blue.

As an example of spatial division, it is illustrated in the drawing that each pixel PX is provided with a color filter CF that expresses one of the primary colors in an area of the common electrode display panel 20, corresponding to the pixel electrode PE Unlikely, the color filter CF may be provided above or under the pixel electrode PE of the thin film transistor panel 10.

Figure 3:
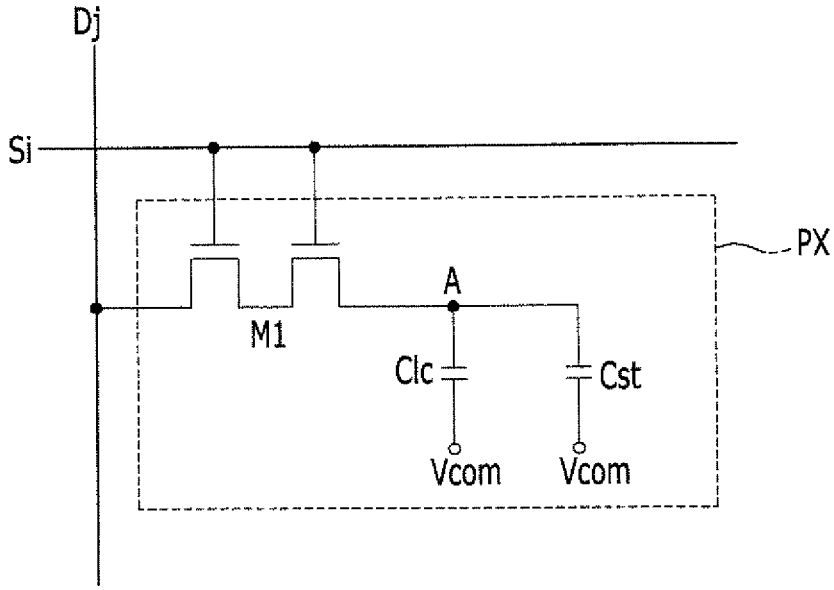
FIG. 3 is a circuit diagram for description of operation of the LCD of FIG. 1.

FIG. 3 is a circuit diagram for description of operation of the liquid crystal display (LCD) of FIG. 1.

FIG. 3 exemplary illustrates a pixel PX connected to the i-th scan line Si and the j-th data line Dj.

When a gate-on voltage is applied to the scan line Si, a data voltage applied to the data line Dj is transmitted to node A. According to a difference between the voltage of node A and the common voltage Vcom, the sustain capacitor Cst is charged and an electric field is generated in the liquid crystal layer of the liquid crystal capacitor Clc. Transmittance of light passing through the liquid crystal capacitor Clc is controlled such that an image is displayed. That is, a data signal is written in each pixel. The sustain capacitor Cst maintains an electric field generated in the liquid crystal layer of the liquid crystal capacitor Clc to be consistent.

The operation of the LCD according to the exemplary embodiment of the present invention will now be described in further detail with reference to FIG. 1 to FIG. 6.

Figure 5:
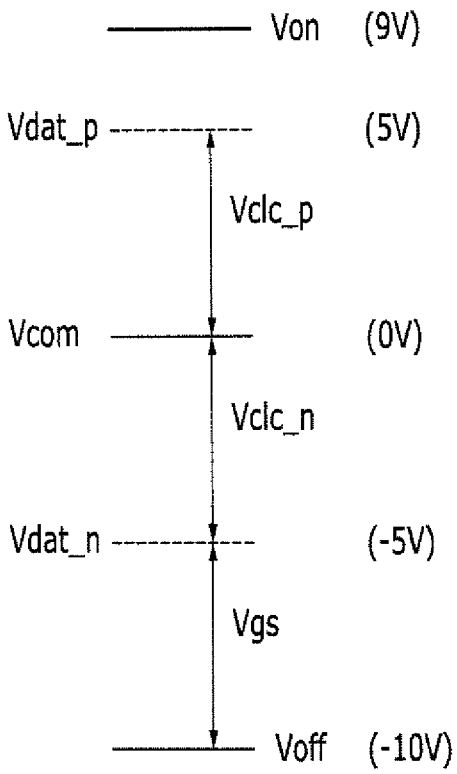
FIG. 5 shows a scan signal, a data voltage, and a common voltage applied during a data writing period according to operation of the LCD of FIG. 1.
Figure 6:
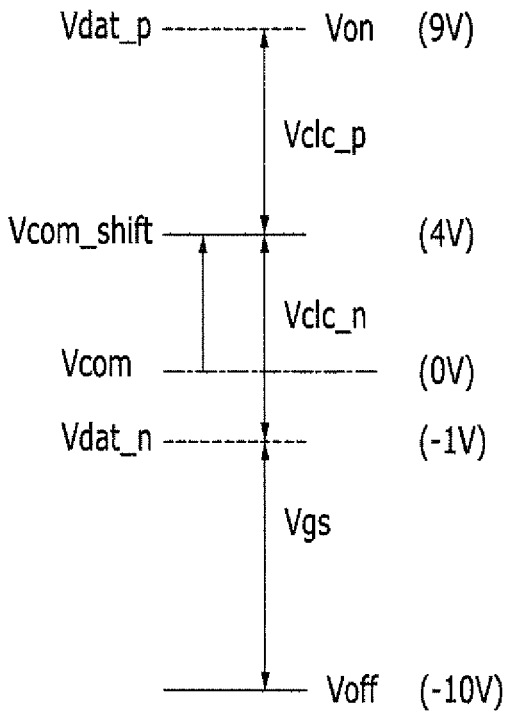
FIG. 6 shows a scan signal, a data voltage, and a shift common voltage applied during a sustain period according to the operation of the LCD of FIG. 1.

FIG. 4 is a timing diagram for description of the operation of the LCD of FIG. 1. FIG. 5 shows a scan signal, a data voltage, and a common voltage applied during a data writing period according to the operation of the LCD of FIG. 1. FIG. 6 shows a scan signal, a data voltage, and a shifted_common voltage applied during a sustain period according to the operation of the LCD of FIG. 1.

The LCD according to the exemplary embodiment of the present invention displays an image using a frame including a data writing period for inputting a data voltage Vdat to the plurality of pixels PX and a sustain period during which the plurality of pixels PX emit light corresponding to the data voltage Vdat input thereto. The data voltage Vdat is a voltage of a data signal applied to the plurality of data lines D1 to Dm.

In addition, the LCD according to the exemplary embodiment of the present invention can be driven through frame reverse driving or line reverse driving. The frame reverse is a method that, when one frame is finished and the next frame is started, a polarity of a data signal applied to each pixel PX becomes opposite to a polarity of the previous frame according to a reverse signal. The line reverse is a method that a polarity of a data signal transmitted through one data line is changed (row reverse) or a polarity of a data signal applied to one pixel row is alternately changed (column reverse) according to a characteristic of the reverse signal within one frame.

Referring to FIGS. 1-4 and 5, the signal controller 100 receives the image signals R, G, and B input from the external device and the input control signal that controls the image signals. The image signals R, G, and B include luminance of each pixel PX, and the luminance has a predetermined number of grays, e.g., $1024=2^{10}$, $256=2^{8}$, or $64=2^{6}$. The input control signal exemplary includes a vertical synchronization signal Vsync, a horizontal synchronization signal Hsync, a main clock MCLK, and a data enable signal DE.

The signal controller 100 properly processes the input image signals R, G, and B according to an operation condition of the liquid crystal panel assembly 600 and the data driver 300 based on the input image signals R, G, and B and the input control signal and generates a scan control signal CONT1, a data control signal CONT2, and a power control signal CONT3. The scan control signal CONT1 is transmitted to the scan driver 200. The data control signal CONT2 and the processed image data signal DAT are transmitted to the data driver 300. The power control signal CONT3 is transmitted to the power supply 400.

The data driver 300 receives an image data signal DAT and selects a gray voltage corresponding to the image data signal DAT to convert a digital image data signal to an analog image data signal. The analog image data signal is input to the plurality of data lines D1 to Dm as a data signal input to each pixel PX.

Data Writing Period

During a data writing period, the power supply 400 applies the common voltage Vcom. The scan driver 200 sequentially applies scan signals Vg1 to Vgn having the gate-on voltage Von to the plurality of scan lines S1 to Sn according to the scan control signal CONT1 to turn on the switching transistor M1 connected to the respective scan line S1 to Sn.

The switching transistor M1 may be an n-channel field effect transistor. In this case, the gate-on voltage Von that turns on the switching transistor M1 is a logic high level voltage and the gate-off voltage Voff that turns off the switching transistor M1 is a logic low level voltage. Alternatively, the switching transistor M1 may be a p-channel field effect transistor. In this case, the gate-on voltage Von is a logic low level voltage and the gate-off voltage Voff is a logic high level voltage. In the present exemplary embodiment, the switching transistor M1 is an n-channel field effect transistor.

The data driver 300 applies the data voltage Vdat corresponding to a plurality of pixels PX of one pixel row among a plurality of pixel rows to the plurality of data lines D1 to Dm according to the data control signal CONT2. That is, the data driver 300 applies the data voltage Vdat corresponding to each of the plurality of pixels PX through the turned-on switching transistor M1. Each of the data voltages Vdat applied to the plurality of data lines D1 to Dm during the data writing period is applied to the corresponding pixel PX through the turned-on switching transistor M1.

As the LCD is driven through the frame reverse driving or the line reverse driving, the data voltage Vdat has a voltage (hereinafter, a positive data voltage (Vdat_p)) that is higher than the common voltage Vcom or a voltage (hereafter, a negative data voltage Vdat_n)) that is lower than the common voltage Vcom. In the frame reverse driving, the positive data voltage Vdat_p is applied during one frame and the negative data voltage Vdat_n is applied during the next frame. In the line reverse driving, the positive data voltage Vdat_p is applied to one pixel row and the negative data voltage Vdat_n is applied to the next pixel row.

A difference between the data voltage Vdat applied to each pixel and the common voltage Vcom becomes a charging voltage, that is, a pixel voltage of the liquid crystal capacitor Clc. Liquid crystal molecules of each pixel have different alignment according to a pixel voltage, and accordingly, polarization of light passing through the liquid crystal layer 30 is changed. Such a polarization change is represented through light transmittance change by a polarizer provided in the liquid crystal panel assembly 600 such that a desired image can be displayed.

By repeating such a process during 1 horizontal (1H) period (which is the same as a period of a horizontal synchronization Hsync signal and a data enable signal DE), the gate-on voltage Von is sequentially applied to the entire scan lines S1 to Sn and all the pixels PX are applied with the data signal.

Referring to FIG. 5, a scan signal Vg, a data voltage Vdat, and a common voltage Vcom applied during the data writing period are compared. Since the switching transistor M1 is an n-channel field effect transistor, the gate-on voltage Von of the scan signal Vg is applied as a logic high level voltage that is higher than the positive data voltage Vdat_p, and the gate-off voltage Voff is applied as a logic low level voltage that is lower than the negative data voltage Vdat_n. The liquid crystal capacitor Clc of each pixel is charged by an amount corresponds to a difference Vclc_p between the positive data voltage Vdat_p and the common voltage Vcom or a different Vclc_n between the negative data voltage Vdat_n and the common voltage Vcom.

For example, the common voltage Vcom is maintained with a constant voltage level of 0V voltage during the data writing period, and the data voltage Vdat may be applied as a positive data voltage Vdat_p of between 0V to 5V or a negative voltage Vdat_n of between −5V to 0V corresponding to the data signal. In this case, the gate-on voltage Von that turns on the switching transistor M1 that is an n-channel field effect transistor is exemplary set to 9V and the gate-off voltage Voff is exemplary set to −10V. When the gate-on voltage Von of 9V is applied to the gate terminal of the switching transistor M1 and the data voltage Vdat of 0V to 5V or −5V to 0V is input to the input terminal of the switching transistor M1, the switching transistor M1 is turned on and the data voltage Vdat is charged to the liquid crystal capacitor Clc of the pixel. When the gate-off voltage Voff of −10V is applied to the gate terminal of the switching transistor M1 after the data voltage Vdat is input to the corresponding pixel, the switching transistor M1 is turned off and the liquid crystal capacitor Clc of the pixel is maintained with a pixel voltage that corresponds to a difference between the common voltage Vcom and the data voltage Vdat. In this case, a gate-source voltage Vgs of the switching transistor M1 becomes a difference between the gate-off voltage Voff applied to the gate terminal and the pixel voltage, and the minimum value of the gate-source electrode Vgs becomes a difference between the gate-off voltage Voff of −10V and the minimum value (i.e., −5V) of the negative data voltage Vdat_n, that is, 5V.

As the gate-source voltage Vgs of the switching transistor M1 is increased, the leakage current through the switching transistor M1 can be decreased. For this, a range of the gate-on voltage Von and the gate-off voltage Voff of the scan signal Vg may be increased, but when the range is increased, power consumption is consequently increased and this it is inefficient in power consumption reduction of the LCD. Thus, the gate-on voltage Von and the gate-off voltage Voff of the scan signal Vg are determined within a proper range for turning on/off the switching transistor M1.

Sustain Period

Referring to FIGS. 1-4 and FIG. 6, during a sustain period, the scan driver 200 applies the gate-off voltage Voff to the plurality of scan lines S1 to Sn to turn off the switching transistor M1 of each pixel. The gate-off voltage Voff that turns off the switching transistor M1, that is an n-channel field effect transistor, is a logic low level voltage that is lower than the data voltage Vdat applied to the node A. When the switching transistor M1 is formed with a p-channel field effect transistor, the gate-off voltage Voff is a logic high level voltage that is higher than the data voltage Vdat applied to the node A.

The power supply 400 applies a shifted common voltage Vcom_shift shifted to a predetermined level voltage from the common voltage Vom to the common electrode CE during the sustain period. When the switching transistor M1 is an n-channel field effect transistor and the gate-off voltage Voff is a logic low level voltage, the shifted common voltage Vcom_shift becomes a voltage higher by a predetermined level than the common voltage Vcom. When the switching transistor M1 is a p-channel field effect transistor and the gate-off voltage Voff is a logic high level voltage, the shifted common voltage Vcom_shift becomes a voltage lower by a predetermined level than the common voltage Vcom.

Hereinafter, it is assumed that the shifted common voltage Vcom_shift is voltage increased by a predetermined level from the common voltage Vcom.

The liquid crystal capacitor Clc of each pixel, applied with data is in the state of being charged with a pixel voltage that corresponds to a difference between the data voltage Vdat and the common voltage Vcom. In this case, when the common voltage Vcom is increased to the shifted common voltage Vcom_shift, the voltage of the node A is increased by a difference between the shifted common voltage Vcom_shift and the common voltage Vcom. As the voltage of the node A is increased, a difference between the node A and the gate-off voltage Voff is further increased. That is, the gate-source voltage of the switching transistor M1 is increased. As the gate-source voltage of the switching transistor M1 is increased, the leakage current flowing through the switching transistor M1 can be reduced.

Referring to FIG. 6, the scan signal Vg, the data voltage Vdat, and the common voltage Vcom applied during the sustain period are compared. The liquid crystal capacitor Clc of each pixel, applied with data is in the state of being charged with a difference Vclc_p between the positive data voltage Vdat_p and the common voltage Vcom or in the state of being changed with a difference Vclc_n between the negative data voltage Vdat_n and the common voltage Vcom.

At the sustain period, when the common voltage Vcom is increased to the shifted common voltage Vcom_shift, the voltage of the node A is increased by the difference between the shifted common voltage Vcom_shift and the common voltage Vcom. That is, the positive data voltage Vdat_p and the negative data voltage Vdat_n applied to the node A are increased by the difference between the shifted common voltage Vcom_shift and the common voltage Vcom. Accordingly, the gate-source voltage of the switching transistor M1 is increased.

For example, it is assumed that the shifted common voltage Vcom_shift is 4V when the common voltage Vcom is 0V, the gate-on voltage Von of the scan signal Vg is 9V, and the data voltage Vdat is a positive data voltage Vdat_p of 0 to 5V or a negative data voltage Vdat_n of −5 to 0V. In this assumption, the positive data voltage Vdat_p and the negative data voltage_n applied to the node A are respectively increased from 4V to 9V and from −1V to 4V as common voltage Vcom is increased to the shifted common Vcom_shift of 4V. The minimum value of the gate-source voltage Vgs of the switching transistor M1 becomes 9V that corresponds to a difference between the gate-off voltage Voff of −10 V applied to the gate terminal and the minimum value (i.e., −1V) of the negative data voltage Vdat_n. That is, the common voltage Vcom of 0V is applied so that the minimum voltage of the gate-source voltage Vgs of the switching transistor M1 was 5V during the data writing period, but the shifted common voltage Vcom_shift of 4V is applied during the sustain period so that the minimum value of the gate-source voltage Vgs of the switching transistor M1 can be increased to 9V.

Since the gate-source voltage Vgs of the switching transistor M1 is increased during the sustain period, the leakage current through the switching transistor M1 can be reduced.

As described, the influence of the leakage current can be reduced without increasing capacitance of the sustain capacitor Cst that maintains the pixel voltage at a constant level by applying the shifted common voltage Vcom_shift during the sustain period.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, it will be appreciated to those skilled in the art that various modifications are made and other equivalent embodiments are available. Accordingly, the actual scope of the present invention must be determined by the spirit of the appended claims.

What is claimed is:

1. A driving method of a liquid crystal display device having a plurality of pixels arranged in a matrix format, said method comprising the steps of:

during a data writing period, sequentially turning on switching transistors of all of the pixels, and data writing for applying corresponding data voltages to all of the pixels while applying a single common voltage simultaneously to all of the pixels during a data writing period; and during a sustain period which immediately follows the data writing period, turning off the switching transistors of all the pixels, sustaining for applying a single shifted common voltage shifted by a predetermined level from the common voltage simultaneously to all of the pixels, and emitting light by all of the pixels corresponding to the data voltages;

wherein the shifted common voltage is shifted to an opposite polarity relative to a polarity of gate-off voltages applied to the plurality of pixels to float the plurality of pixels.

2. The driving method of claim 1, wherein during the data writing period, turning on the switching transistor respectively connected to each of the plurality of pixels by sequentially applying a gate-on voltage to a plurality of scan lines respectively connected to the plurality of pixels; and applying a data voltage corresponding to each of the plurality of pixels through the turned-on switching transistor.

3. The driving method of claim 2, further comprising the step of turning off the switching transistors connected to the respective scan lines by applying the gate-off voltage to the scan lines during the data writing period.

4. The driving method of claim 3, wherein a voltage difference between a gate terminal and a source terminal of the turned-off switching transistors is increased by applying the shifted common voltage.

5. The driving method of claim 3, wherein the switching transistors are n-channel field effect transistors.

6. The driving method of claim 5, wherein the gate-on voltage is a logic high level voltage and the gate-off voltage is a logic low level voltage.

7. The driving method of claim 6, wherein the shifted common voltage is a voltage increased by a predetermined level from the common voltage.

8. The driving method of claim 3, wherein the switching transistors are p-channel field effect transistors.

9. The driving method of claim 8, wherein the gate-on voltage is a logic low level voltage and the gate-off voltage is a logic high level voltage.

10. The driving method of claim 9, wherein the shifted common voltage is decreased by a predetermined level from the common voltage.

11. A liquid crystal display device, comprising:

a liquid crystal panel including a plurality of pixels arranged in a matrix format;

a scan driver connected to each of a plurality of scan lines connected to the plurality of pixels, each of the pixels including a switching transistor connected to corresponding ones of the scan lines, the scan driver turning on the switching transistors by sequentially applying a gate-on voltage to the plurality of scan lines during a data writing period during which the switching transistors of all of the pixels are sequentially turned on by the scan driver;

a data driver applying data voltages corresponding to all of the plurality of pixels through the turned-on switching transistors during the data writing period; and a power supply applying a single common voltage simultaneously to all of the plurality of pixels during the data writing period;

wherein the scan driver sequentially applies a gate-off voltage to each of the scan lines to turn off the switching transistors of each of the scan lines after the data voltages are applied to the plurality of pixels connected to the corresponding scan lines, and, during a sustain period, which immediately follows the data writing period, in which the switching transistors of all the pixels are turned off by the scan driver and all of the plurality of pixels emit light, the power supply applies a single shifted common voltage simultaneously to all of the plurality of pixels, and the shifted common voltage is shifted to an opposite polarity relative to a polarity of the gate-off voltage to float the plurality of pixels.

12. The liquid crystal display of claim 11, wherein the switching transistors are n-channel field effect transistors.

13. The liquid crystal display of claim 12, wherein the gate-on voltage is a logic high level voltage and the gate-off voltage is a logic low level voltage.

14. The liquid crystal display of claim 13, wherein the shifted common voltage is a voltage increased by a predetermined level from the common voltage.

15. The liquid crystal display of claim 11, wherein the switching transistors are p-channel field effect transistors.

16. The liquid crystal display of claim 15, wherein the gate-on voltage is a logic low level voltage and the gate-off voltage is a logic high level voltage.

17. The liquid crystal display of claim 16, wherein the shifted common voltage is a voltage decreased by a predetermined level from the common voltage.

18. A liquid crystal display device, comprising:

a liquid crystal panel including a plurality of pixels, each of the pixels comprising:

a switching transistor receiving a gate-on voltage from a scan driver via a corresponding scan line during a data writing period for all of the pixels;

the switching transistor receiving a data voltage from a data driver, and receiving a gate-off voltage that turns off the switching transistor after the data voltage is applied to the pixel during the data writing period;

a liquid crystal capacitor connected in parallel with a sustain capacitor, and commonly connected to the switching transistor; and a power supply applying a common voltage to the liquid crystal capacitor and the sustain capacitor during the data writing period, and applying a shifted common voltage to the liquid crystal capacitor and the sustain capacitor during a sustain period immediately following the data writing period, the shifted common voltage being shifted to an opposite polarity relative to a polarity of the gate-off voltage, each of the pixels connected to receive the same common voltage, and to receive simultaneously the same shifted common voltage, during the data writing period, the switching transistors of all of the pixels being sequentially turned on, and during the sustain period, the switching transistors of all the pixels being turned off.

* * * * *